US011020636B2

(12) United States Patent
Aramaki

(10) Patent No.: US 11,020,636 B2
(45) Date of Patent: Jun. 1, 2021

(54) GOLF CLUB HEAD

(71) Applicant: Sumitomo Rubber Industries, Ltd., Hyogo (JP)

(72) Inventor: Tomotaka Aramaki, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/829,077

(22) Filed: Mar. 25, 2020

(65) Prior Publication Data

US 2020/0324173 A1 Oct. 15, 2020

(30) Foreign Application Priority Data

Apr. 9, 2019 (JP) ..... JP2019-074356

(51) Int. Cl.
*A63B 53/04* (2015.01)
*A63B 102/32* (2015.01)

(52) U.S. Cl.
CPC ..... *A63B 53/04* (2013.01); *A63B 53/0408* (2020.08); *A63B 53/0433* (2020.08); *A63B 53/0458* (2020.08); *A63B 2053/0491* (2013.01); *A63B 2102/32* (2015.10)

(58) Field of Classification Search
CPC . A63B 60/00; A63B 60/46; A63B 2053/0491; A63B 53/0433; A63B 53/04; A63B 53/0408; A63B 53/045; A63B 53/0466; A63B 2102/32
USPC ..... 473/335, 324, 328
See application file for complete search history.

(56) References Cited

U.S. PATENT DOCUMENTS 4,332,388 A * 6/1982 Crow ..... A63B 53/0466 473/328
5,213,328 A * 5/1993 Long ..... A63B 53/0466 473/346
6,102,813 A * 8/2000 Dill ..... A63B 53/04 473/305
9,782,642 B1 * 10/2017 DeMille ..... A63B 53/0475
2003/0220155 A1 * 11/2003 Nishitani ..... A63B 53/0466 473/335
2006/0094526 A1 * 5/2006 Reed ..... A63B 60/00 473/328
2009/0280924 A1 * 11/2009 Harvell ..... A63B 60/00 473/335

(Continued)

FOREIGN PATENT DOCUMENTS

JP 2009240653 A 10/2009

*Primary Examiner* — John E Simms, Jr.
(74) *Attorney, Agent, or Firm* — Studebaker & Brackett PC

(57) ABSTRACT

A hollow golf club head includes a face portion, and a sole portion including a toe-side thick walled portion formed on a toe-side thereof, a heel-side thick walled portion formed on a heel-side thereof, and a middle thin walled portion formed between the toe-side thick walled portion and the heel-side thick walled portion. At least a part of the toe-side thick walled portion and at least a part of the heel-side thick walled portion are located on the face portion to a club head center of gravity. The middle thin walled portion having a smaller thickness than the toe-side thick walled portion and the heel-side thick walled portion. The sole portion is provided with a toe-side through hole between the toe-side thick walled portion and the middle thin walled portion and a heel-side through hole between the heel-side thick walled portion and the middle thin walled portion.

18 Claims, 11 Drawing Sheets

(56) References Cited

U.S. PATENT DOCUMENTS

| | | | | |
|---|---|---|---|---|
| 2014/0342847 | A1* | 11/2014 | Mitzel | A63B 53/0466<br>473/345 |
| 2015/0065265 | A1* | 3/2015 | Motokawa | A63B 53/04<br>473/335 |
| 2015/0238827 | A1* | 8/2015 | Nakamura | A63B 53/0466<br>473/345 |
| 2016/0250525 | A1* | 9/2016 | Motokawa | A63B 60/04<br>473/336 |

* cited by examiner

GOLF CLUB HEAD

BACKGROUND ART

Field of the Disclosure

The present disclosure relates to a golf club head.

Description of the Related Art

Conventionally, various techniques that optimize center of gravity positions of golf club heads have been proposed (e.g., see the Patent Document 1 below).

Patent Document

[Patent document 1] Japanese Unexamined Patent Application Publication 2009-240653

SUMMARY OF THE DISCLOSURE

Golf club heads having a hollow therein, especially golf club heads called as fairway wood and hybrid which have many opportunities to strike a ball placed on the ground directly have been required to have a low sweet spot height in order to maximize golfer's distance. It may be thought to design a golf club head with shallow center of gravity by providing a thick walled portion nearby the face portion on the sole of the golf club head, allocating much weight to the face portion side. This is because making the center of gravity of the club head shallow lowers the sweet spot due to the structure of the head. Unfortunately, such a golf club head has high stiffness of the sole nearby the face portion, thus interfering elastic deflection of the sole upon striking a ball, resulting in a new problem that deteriorates repulsion performance.

The present disclosure has been made in view of the above circumstances and has a major object to provide a golf club head capable of improving repulsion performance while lowering sweet spot.

In one aspect of the disclosure, a golf club head having a hollow therein, the golf club head includes a face portion, and a sole portion including a toe-side thick walled portion formed on a toe-side thereof, a heel-side thick walled portion formed on a heel-side thereof, and a middle thin walled portion formed between the toe-side thick walled portion and the heel-side thick walled portion, at least a part of the toe-side thick walled portion and at least a part of the heel-side thick walled portion being located on the face portion side with respect to a club head center of gravity, the middle thin walled portion having a thickness smaller than a thickness of the toe-side thick walled portion and a thickness of the heel-side thick walled portion, wherein the sole portion is provided with a toe-side through hole piercing the sole portion between the toe-side thick walled portion and the middle thin walled portion and a heel-side through hole piercing the sole portion between the heel-side thick walled portion and the middle thin walled portion.

In another aspect of the disclosure, the toe-side through hole may haves a length in in a front-back direction of the club head greater than a width thereof in a toe-heel direction of the club head.

In another aspect of the disclosure, the toe-side through hole may have a length in a front-back direction of the club head greater than a length in a front-back direction of the toe-side thick walled portion.

In another aspect of the disclosure, the heel-side through hole may have a length in a front-back direction of the club head greater than a width thereof in a toe-heel direction of the club head.

In another aspect of the disclosure, the heel-side through hole may have a length in a front-back direction of the club head greater than a length in a front-back direction of the heel-side thick walled portion.

In another aspect of the disclosure, the thickness of the toe-side thick walled portion and the thickness of the heel-side thick walled portion may be greater than 2.0 mm.

In another aspect of the disclosure, the thickness of the middle thin walled portion may be equal to or less than 2.0 mm.

In another aspect of the disclosure, at least a part of the middle thin walled portion may be provided in a region that has a 50% length of a maximum club head length in a front-back direction of the club head from a leading edge of the club head.

In another aspect of the disclosure, the toe-side thick walled portion may be provided with a toe-side projected portion extending toward a heel side of the club head without contacting with an inner surface of the sole portion.

In another aspect of the disclosure, in a bottom view of the club head, the toe-side projected portion may extend so as to overlap with the toe-side through hole at least partially.

In another aspect of the disclosure, the heel-side thick walled portion may be provided with a heel-side projected portion extending toward a toe side of the club head without contacting with an inner surface of the sole portion.

In another aspect of the disclosure, in a bottom view of the club head, the heel-side projected portion may extend so as to overlap with the heel-side through hole at least partially.

In another aspect of the disclosure, the middle thin walled portion may be provided with one or more recessed grooves extending in a toe-heel direction of the club head.

In another aspect of the disclosure, the golf club head may have a loft angle of 13 to 35 degrees, and a sweet spot height equal to or less than 25 mm.

DESCRIPTION OF THE PREFERRED EMBODIMENTS

Figure 1:
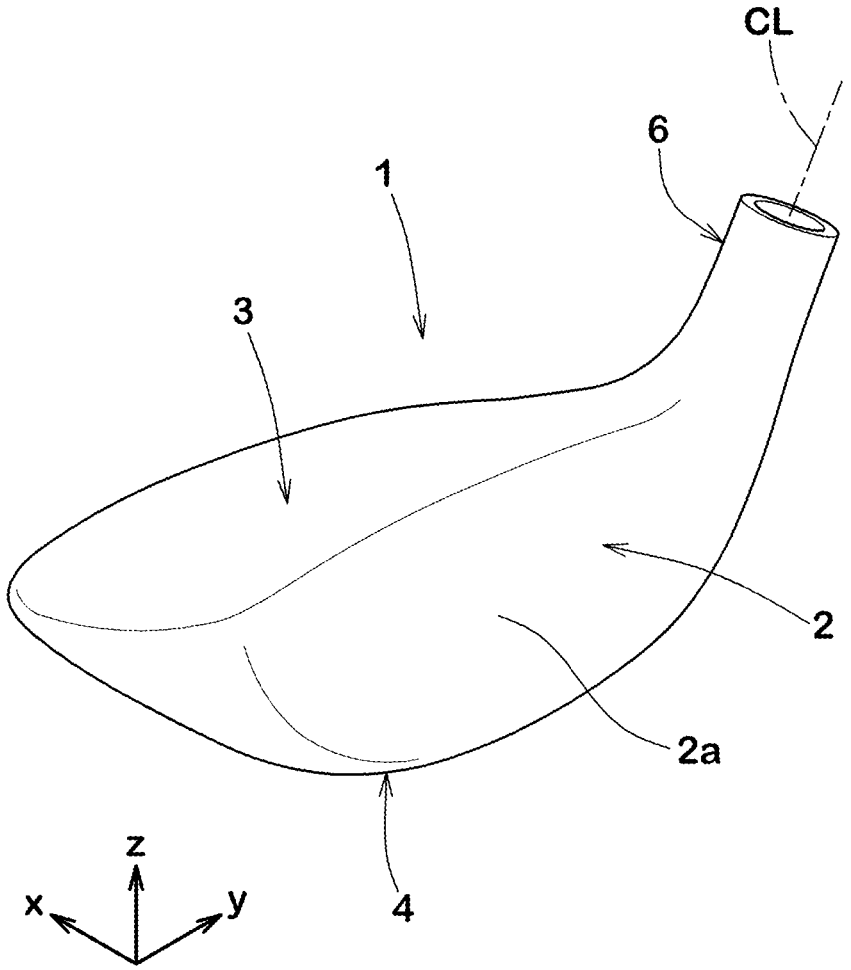
FIG. 1 is a perspective view of a golf club head according to one embodiment of the disclosure.

An embodiment of the present disclosure will be explained below with reference to the accompanying drawings.

Note that the same elements or parts are denoted by the same reference numerals throughout the embodiments, and that redundant description of already described elements is omitted.

Figure 2:
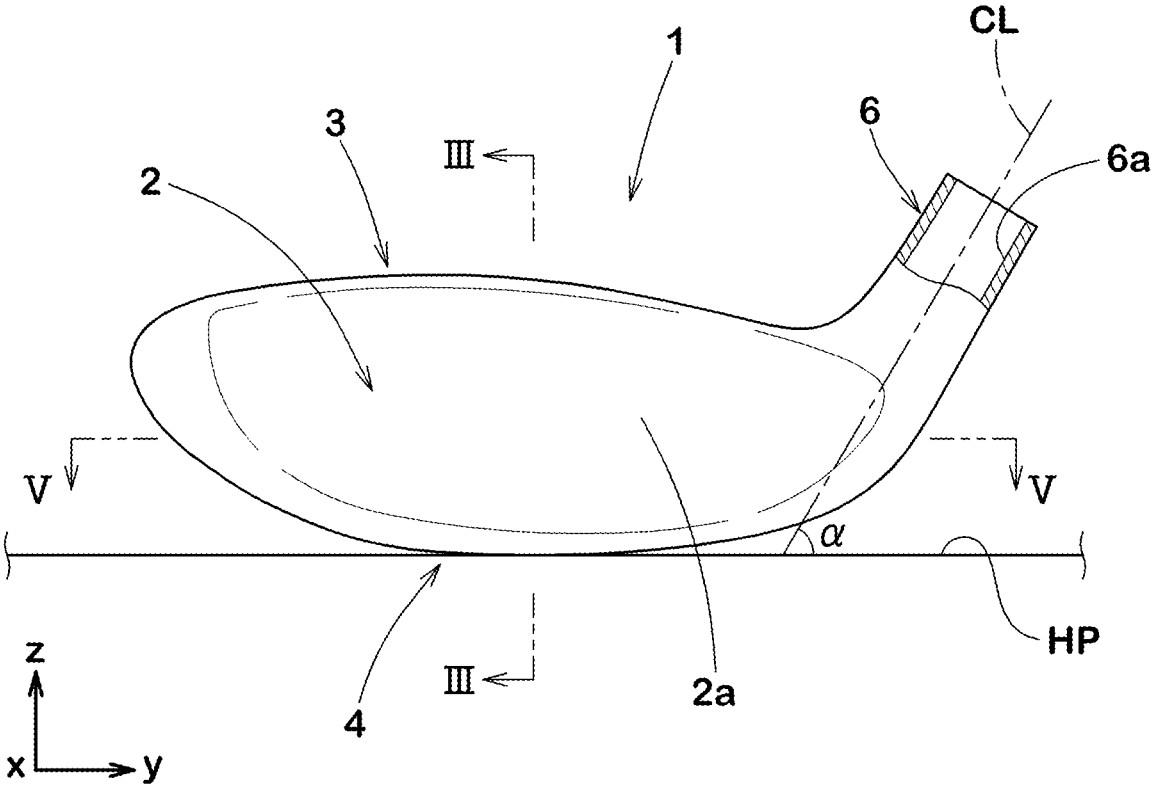
FIG. 2 is a front view of the golf club head in FIG. 1.
Figure 3:
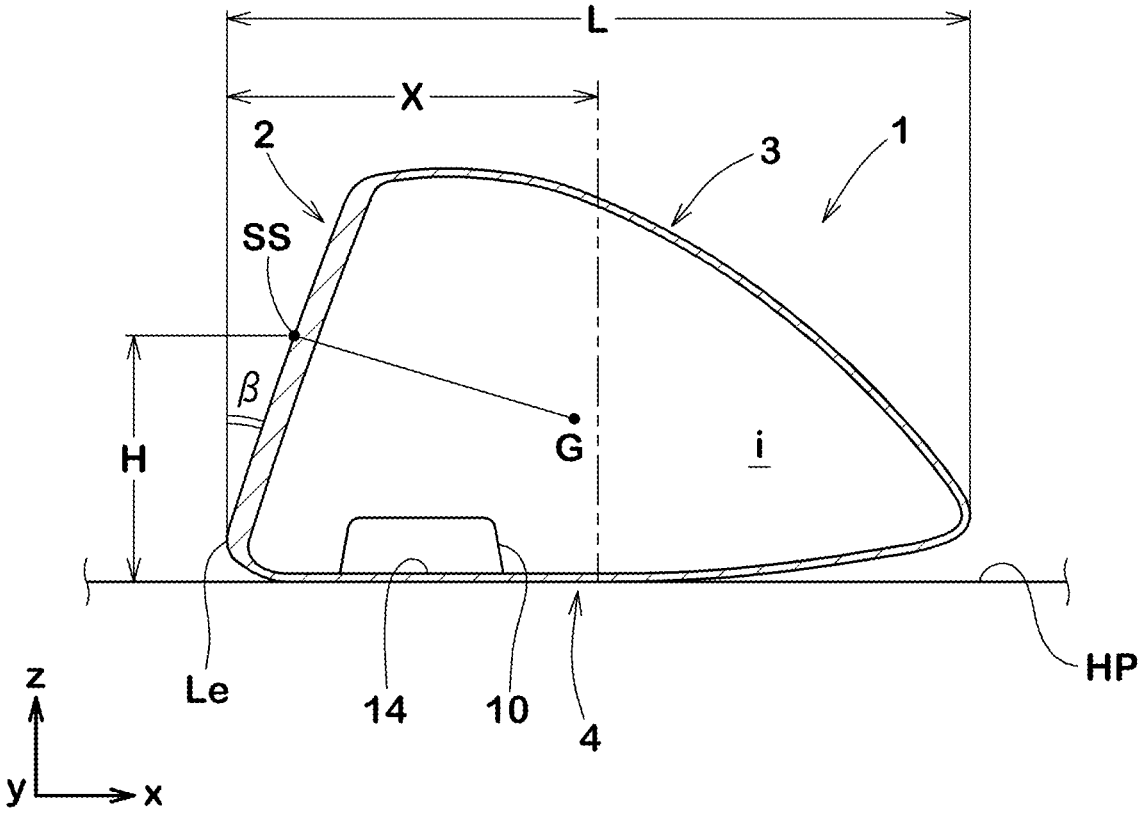
FIG. 3 is a cross-sectional view taken along lines III-III of FIG. 2.
Figure 4:
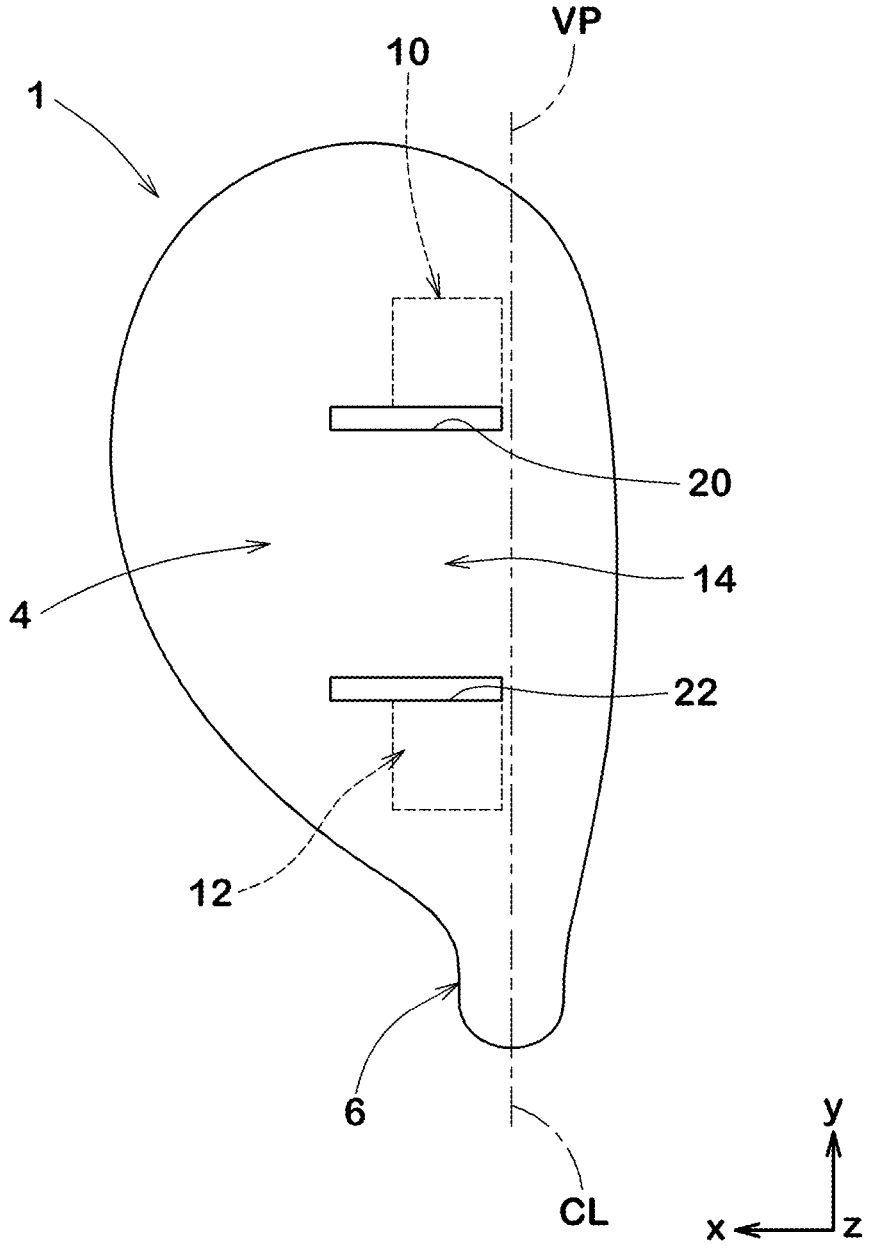
FIG. 4 is a bottom view of the golf club head according to the embodiment.

FIG. 1 illustrates a perspective view of a golf club head (hereinafter, simply referred to as "head") 1 according to the present embodiment. FIG. 2 illustrates a front view of the head 1. FIG. 3 illustrates a cross-sectional view taken along lines III-III of FIG. 2. FIG. 4 illustrates a bottom view of the head 1.

[Reference State of Head]

In FIGS. 1 to 4, the head 1 is placed under its reference state. The reference state is such a state in which the head 1 is placed on a horizontal plane HP at its loft angle θ (FIG. 3) and lie angle α (FIG. 2) with respect to the horizontal plane HP. Additionally, in the reference state, a club shaft center line CL of the head 1 is located within a vertical plane VP. The club shaft center line CL is defined as the center line of a shaft insertion hole 6*a* provided on a hosel portion 6 of the head 1. As used herein, unless otherwise noted, the head 1 shall be under the reference state.

[Coordinate System of Head]

As used herein, an x-y-z coordinate system is defined on the head 1. The x-axis is an axis parallel with the horizontal plane HP and orthogonal to the vertical plane VP. The y-axis is an axis parallel with both vertical plane VP and horizontal plane HP. The z-axis is an axis orthogonal to both x and y axes. Additionally, as to the head 1, the front-back direction means a direction parallel to the x-axis, the toe-heel direction means a direction parallel with the y-axis, and the up-down direction means a direction parallel to the z-axis. Note that as to the front-back direction, the front means the face portion 2 side, and the back means the opposite side thereto.

[Basic Configuration of Head]

The head 1 according to the present embodiment is provided therein with a hollow (i). Additionally, the head 1 according to the present embodiment is configured as a golf club head that is suitable for striking a ball placed directly on the ground. As such an example, fairway wood or hybrid may be preferred. These types of head typically may have a loft angle β of 13 to 35 degrees, head volume of about 85 to 250 cc, head weight of about 190 to 240 g, and a maximum length L (shown in FIG. 3) in the front-back direction of 45 to 100 mm.

Fairway wood, for example, may include a spoon (#3), a buff (#4), a creek (#5), other woods (#7 and #9) and the like. Hybrids are well known in the art, for example, as having an intermediate shape between wood-type heads and iron-type heads.

The head 1 includes the face portion 2, a crown portion 3 and a sole portion 4 so as to define the hollow (i).

As illustrated in FIG. 3, the hollow (i), for example, may be used as a void space as it is, or a gel agent for weight adjustment may be placed in part of it.

The face portion 2 is for striking a ball, and is formed on the front side of the head 1. The face portion 2 has a striking face 2*a* that comes into contact with a ball directly. The striking face 2*a* may be provided with one or more grooves (not illustrated) extending in the toe-heel direction which may be called as face lines.

The crown portion 3 extends backwardly from an upper edge of the face portion 2 to form an upper face of the head 1. In a heel side of the crown portion 3, the above-mentioned hosel portion 6 is formed. The hosel portion 6 has the shaft insertion hole 6*a* to which a golf club shaft (not shown) is attached.

The sole portion 4 extends backwardly from a lower edge of the face portion 2 to form a bottom face of the head 1. As illustrated in FIG. 2, the sole portion 4, for example, has a curved surface shape that is curved to be convex toward the bottom face of the head 1.

In the present embodiment, the face portion 2, the crown portion 3 and the sole portion 4, for example, are made of metal material. As the metal material, various metal materials, e.g., stainless steels, maraging steel, titanium alloys, magnesium alloy, aluminum alloys and the like may be preferable. In another aspect, a part of the head 1 (for example, the crown portion 3) may be made of a non-metallic material such as fiber reinforced plastic and the like.

[Toe-Side Thick Walled Portion and Heel-Side Thick Walled Portion]

Figure 5:
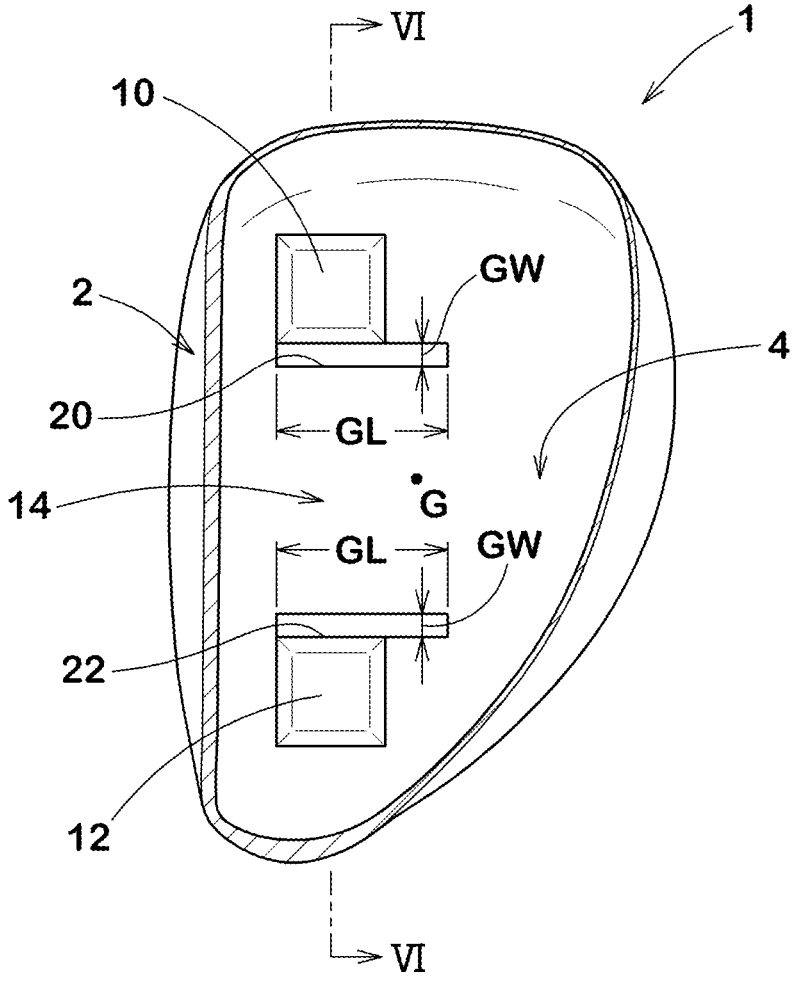
FIG. 5 is a cross-sectional view taken along lines V-V of FIG. 2.
Figure 6:
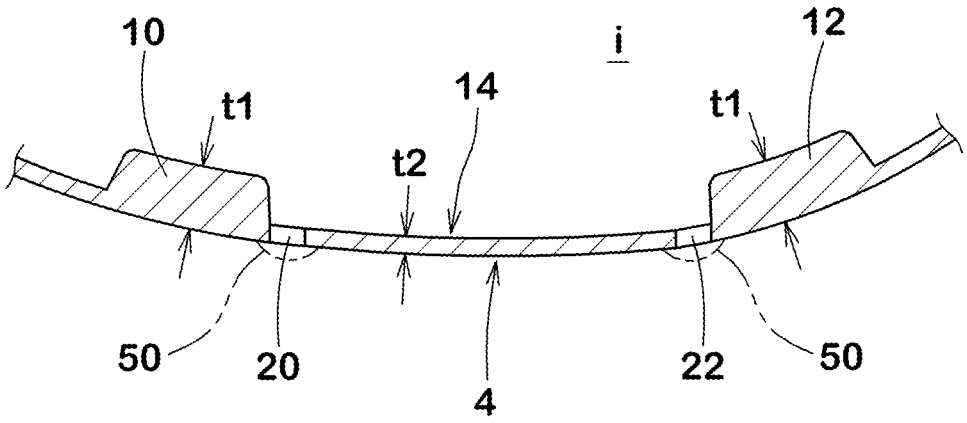
FIG. 6 is a cross-sectional view taken along VI-VI of FIG. 5.

FIG. 5 illustrates a cross-sectional view taken long lines V-V of FIG. 2, and FIG. 6 illustrates a cross-sectional view taken long lines VI-VI of FIG. 5. As illustrated in FIG. 4 to 6, the sole portion 4 includes a toe-side thick walled portion 10 formed on a toe-side of the sole portion 4, a heel-side thick walled portion 12 formed on a heel-side of the sole portion 4, and a middle thin walled portion 14 formed between the toe-side thick walled portion 10 and the heel-side thick walled portion 12.

In the present embodiment, the toe-side thick walled portion 10 and the heel-side thick walled portion 12 are formed by increasing thicknesses of the respective regions of the sole portion 4. Additionally, the toe-side thick walled portion 10 and the heel-side thick walled portion 12 are formed so as to raise toward the hollow (i) side of the head 1. In another aspect, the toe-side thick walled portion 10 and the heel-side thick walled portion 12 may be formed so as to raise toward outwardly of the head 1.

In the present embodiment, the toe-side thick walled portion 10 and the heel-side thick walled portion 12 are made of the same metal material as with the other portion of the sole portion 4. In another aspect, the toe-side thick walled portion 10 and/or the heel-side thick walled portion 12 may be formed of a material different from a major metal material forming the sole portion 4. In this aspect, the toe-side thick walled portion 10 and/or the heel-side thick walled portion 12 may be fixed to an inner or outer surface of the sole portion 4 through various coupling means.

As apparent from FIG. 3 and FIG. 5, at least a part of the toe-side thick walled portion 10 and at least a part of the heel-side thick walled portion 12 are located on the face portion 2 side with respect to the club head center of gravity G. Thus, the weight near the face portion 2 of the sole portion 4 increases, providing a shallower club head center of gravity G. In such a head 1, since the height H of the sweet spot SS is lowered, a hit point and the sweet spot SS become closer when striking a ball, resulting in improving repulsion performance of the head 1. Additionally, such a head 1 can reduce back spin of hit ball and increase the flight distance. As used herein, the sweet spot SS is the point where the normal drawn from the club head center of gravity G to the striking face 2*a* intersects the striking face 2*a*.

In the present embodiment, although the toe-side thick walled portion 10 and the heel-side thick walled portion 12, for example, are located on the face portion 2 side with respect to the club head center of gravity G as a whole, it is not particularly limited to such an aspect. Alternatively, in one of or both of the toe-side thick walled portion 10 and the heel-side thick walled portion 12, a part thereof may be located backwardly of the club head center of gravity G. In this case, the respective center of gravities of the toe-side thick walled portion 10 and the heel-side thick walled portion 12 are preferably located on the face portion 2 side with respect to the club head center of gravity G.

[Middle Thin Walled Portion]

The middle thin walled portion 14 is provided between the toe-side thick walled portion 10 and the heel-side thick walled portion 12, and has a smaller thickness than the toe-side thick walled portion 10 and the heel-side thick walled portion 12. Thus, the middle thin walled portion 14 can reduce stiffness of a middle region of the sole portion 4 in the toe-heel direction, and thereby it can deflect (elastic deflection) easily when striking a ball.

[Toe-Side Through Hole and Heel-Side Through Hole]

In the head 1 according to the present embodiment, the sole portion 4 is provided with a toe-side through hole 20 piercing the sole portion 4 between the toe-side thick walled portion 10 and the middle thin walled portion 14. Additionally, the sole portion 4 is provided with a heel-side through hole 22 piercing the sole portion 4 between the heel-side thick walled portion 12 and the middle thin walled portion 14.

Generally, the toe-side thick walled portion 10 and the heel-side thick walled portion 12, which are the weight parts for obtaining shallow club head center of gravity G, have higher rigidity than the middle thin walled portion 14. Therefore, if the middle thin walled portion 14 is continuously connected to the toe-side thick walled portion 10 and the heel-side thick walled portion 12, deflection (elastic deflection) of the middle thin walled portion 14 when striking a ball may be hindered by the toe-side thick walled portion 10 and the heel-side thick walled portion 12.

In the present embodiment, due to the toe-side through hole 20 and the heel-side through hole 22, a part of the middle thin walled portion 14 is separated from the toe-side thick walled portion 10 and the heel-side thick walled portion 12. Thus, the middle thin walled portion 14, when striking a ball, can include a portion which can deflect flexibly without receiving an influence of high stiffness of the toe-side thick walled portion 10 and the heel-side thick walled portion 12. Therefore, the head 1 according to the present embodiment can improve repulsion performance thereof by providing the sole portion 4 with a deflection mechanism while offering lower sweet spot SS.

Figure 7:
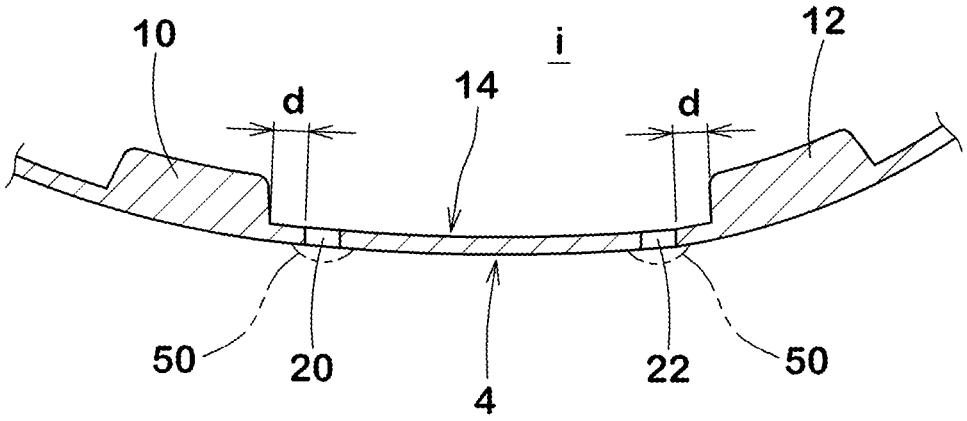
FIG. 7 is a cross-sectional view of a variation taken along lines VI-VI of FIG. 5.

Here, although the toe-side through hole 20 and the heel-side through hole 22 are provided adjacent to the toe-side thick walled portion 10 and the heel-side thick walled portion 12, respectively, as shown in FIG. 6, the disclosure is not limited to such an embodiment. For example, as illustrated in FIG. 7, the toe-side through hole 20 and the heel-side through hole 22 may be provided at a distance d away from the toe-side thick walled portion 10 and the heel-side thick walled portion 12, respectively. Even in this aspect, since the middle thin walled portion 14 located between the toe-side through hole 20 and the heel-side through hole 22 is separated from the toe-side thick walled portion 10 and the heel-side thick walled portion 12, the middle thin wall portion 14 can deflect flexibly when striking a ball.

On the other hand, if the distance d increases, the effect of improving the repulsion performance may not be sufficiently expected. From such a viewpoint, the distanced, for example, is equal to or less than 10.0 mm, preferably equal to or less than 5.0 mm.

It is desirable that the toe-side through hole 20 and the heel-side through hole 22 may be closed by closing members 50 to prevent foreign matter from entering the hollow (i) of the head 1. In this case, as the closing member 50, a nonmetallic elastic material that does not substantially increase stiffness of the sole portion 4 is desirable. As such a member, for example, a cap-shaped material made of rubber or resin, a cured product such as a gel in a fluid state, and the like.

[Preferable Thicknesses of Thick and Thin Walled Portions]

As illustrated in FIG. 6, the toe-side thick walled portion 10 and/or the heel-side thick walled portion 12, for example, may have a thickness t1 greater than 2.0 mm, preferably equal to or more than 3.0 mm, more preferably equal to or more than 4.0 mm. Thus, more weight is distributed near the face portion 2, which helps to provide shallower club head center of gravity G.

The upper limit of the thickness t1 of the toe-side thick walled portion 10 and/or the heel-side thick walled portion 12 is not particularly limited. In order to prevent a significant increase in the head weight, the thickness t may be set equal to or less than 10.0 mm.

Here, the thickness t1 of the toe-side thick walled portion 10 and/or the heel-side thick walled portion 12 is a thickness measured in a vertical direction to an outer surface of sole portion 4. Further, the thickness t1 of the toe-side thick walled portion 10 and the heel-side thick walled portion 12 may be the same or different.

Preferably, the middle thin walled portion 14, for example, has a thickness t2 equal to or less than 2.0 mm, more preferably equal to or less than 1.5 mm. Thus, when striking a ball, the middle thin walled portion 14 can deflect more flexibly, improving repulsion performance of the head 1. From the viewpoint to ensure durability of the sole portion 4, the thickness t2 of the middle thin walled portion 14, for example, equal to or greater than 0.5 mm.

Note that the thickness t2 of the middle thin walled portion 14 is a thickness measured in a vertical direction to an outer surface of sole portion 4. Further, the thickness t2 of the middle thin walled portion 14 may be constant or vary.

[Preferable Aspect of Toe-Side and Heel-Side Through Holes]

The contour shapes of the toe-side through hole 20 and the heel-side through hole 22 are not particularly limited, but various shapes such as a square, a circle, an ellipse, and an oval can be adopted, for example. As illustrated in FIG. 5, in some preferred embodiments, each of the toe-side through hole 20 and/or the heel-side through hole 22 has a length GL thereof in in a front-back direction greater than a width GW thereof in the toe-heel direction. In such an embodiment, while maintaining durability of the sole portion 4, deflection of the middle thin walled portion 14 when striking a ball greatly expands in the front-back direction, resulting in improving repulsion performance of the head 1 further.

The width GW of the toe-side through hole 20 and the heel-side through hole 22 in the toe-heel direction is not particularly limited, but various dimensions can be adopted. In some preferred embodiment, in order to enhance the above effects, the width GW of the toe-side through hole 20 and the heel-side through hole 22 is preferably equal to or greater than 2.0 mm, more preferably equal to or greater than 3.0 mm. On the other hand, when the width GW becomes excessively large, durability of the sole portion 4 tends to deteriorate. From this viewpoint, the width GW is preferably equal to or less than 6.0 mm, more preferably equal to or less than 5.0 mm. In the present embodiment, the toe-side through hole 20 and the heel-side through hole 22 both have a slit-shaped extending in the front-back direction with a constant width.

A length GL of the toe-side through hole 20 and the heel-side through hole 22 in the front-back direction is not particularly limited, but various dimensions can be adopted. In some preferred embodiment, the length of the toe-side through hole 20 and the heel-side through hole 22 is preferably equal to or greater than 10 mm, more preferably equal to or greater than 15 mm. On the other hand, when the length GL becomes excessively large, durability of the sole portion 4 tends to deteriorate. From this viewpoint, the length GL is preferably equal to or less than 40 mm, more preferably equal to or less than 30 mm.

In some more preferred embodiment, the length GL of the toe-side through hole 20 may be configured to be greater than a length of the toe-side thick walled portion 10 in the front-back direction. Similarly, the length GL of the heel-side through hole 22 may be configured to be greater than a length of the heel-side thick walled portion 12 in the front-back direction. In such an embodiment, the middle thin walled portion 14 is separated from the respective thick walled portions 10 and 12 over the entire ranges in the front-back direction. Thus, elastic deflection of the middle thin walled portion 14 when striking a ball may greatly expanded over the front-back direction thereof, resulting in improving repulsion performance of the head 1 further.

[Location of Middle Thin Walled Portion]

In order to improve repulsion performance of the head 1, it is necessary to make the sole portion 4 flexible. At that time, it is important to make a portion of the sole portion 4 closer to the face portion 2 more flexible. From these viewpoints, as illustrated in FIG. 3, at least a part of the middle thin walled portion 14 is preferably provided in a region X that has a 50% length of the maximum club head length L in the front-back direction of the head from a leading edge Le of the head 1. In such an embodiment, repulsion performance of the head 1 can further be improved.

[Variations of Toe-Side and Heel-Side Thick Walled Portions]

Figure 8:
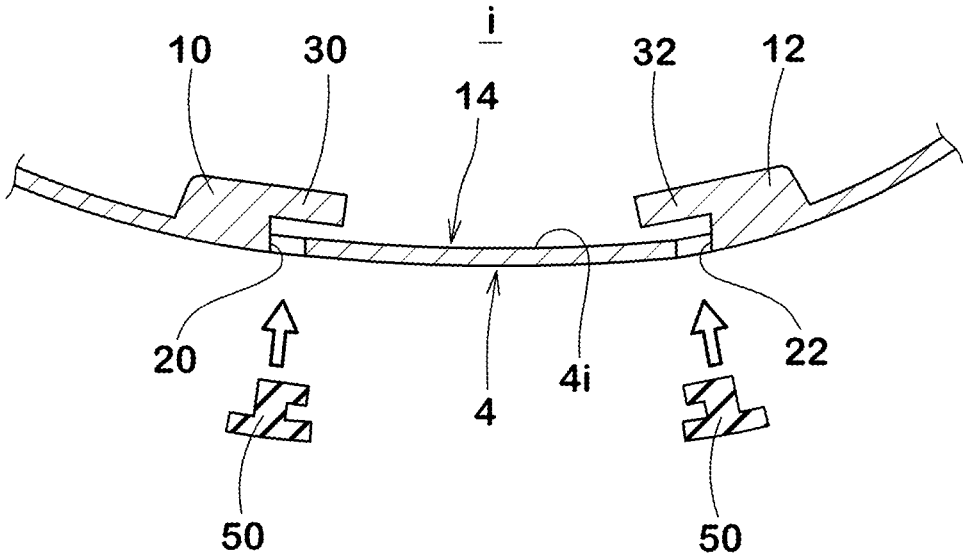
FIG. 8 is a cross-sectional view of another variation taken along lines VI-VI of FIG. 5.

FIG. 8 illustrates a cross-sectional view corresponding to a position taken along lines VI-VI of FIG. 5 as another embodiment of the toe-side thick walled portion 10 and the heel-side thick walled portion 12. In this embodiment, the toe-side thick walled portion 10 is provided with a toe-side projected portion 30 extending toward a heel side of the head 1 without contacting with an inner surface 4*i* of the sole portion 4. The toe-side projected portion 30 extends so as to form a gap between the inner surface 4*i* of the sole portion 4 and the toe-side projected portion 30. Similarly, the heel-side thick walled portion 12 is provided with a heel-side projected portion 32 extending toward a toe side of the head 1 without contacting with the inner surface 4*i* of the sole portion 4. The heel-side projected portion 32 also extends so as to form a gap between the inner surface 4*i* of the sole portion 4 and the heel-side projected portion 32.

The above embodiment can allocate more weight near the face portion 2 without increasing stiffness of the middle thin walled portion 14. Additionally, the toe-side projected portion 30 and the heel-side projected portion 32 can allocate more weight to a low location near the face portion 2 without increasing thicknesses of the toe-side thick walled portion 10 and the heel-side thick walled portion 12 excessively. Thus, this embodiment can improve repulsion performance of the head 1 while lowering the sweet spot SS.

In some preferred embodiments, in a bottom view of the head, the toe-side projected portion 30 extends so as to overlap with the toe-side through hole 20 at least partially, more preferably overlapping with the entire region of toe-side through hole 20. Similarly, in a bottom view of the head, the heel-side projected portion 32 extends so as to overlap with the heel-side through hole 22, more preferably overlapping with the entire region of the heel-side through hole 22. For example, as illustrated in FIG. 8, when attaching closing members 50 from an outer surface side of the head 1 to the toe-side through hole 20 and the heel-side through hole 22, the toe-side projected portion 30 and the heel-side projected portion 32 can support the closing members 50 from the hollow (i) side of the head 1. Thus, in this embodiment, the closing members 50 can be prevented from dropping to the hollow (i) side effectively.

Further, in the above embodiment, in other words, the toe-side through hole 20 and the heel-side through hole 22 may be provided closer to bases of the toe-side thick walled portion 10 and the heel-side thick walled portion 12, respectively. Thus, a formation area of the middle thin walled portion 14 can expand in the toe-heel direction, helping to deflect the sole portion 4 more flexibly.

[Other Variations]

Figure 9:
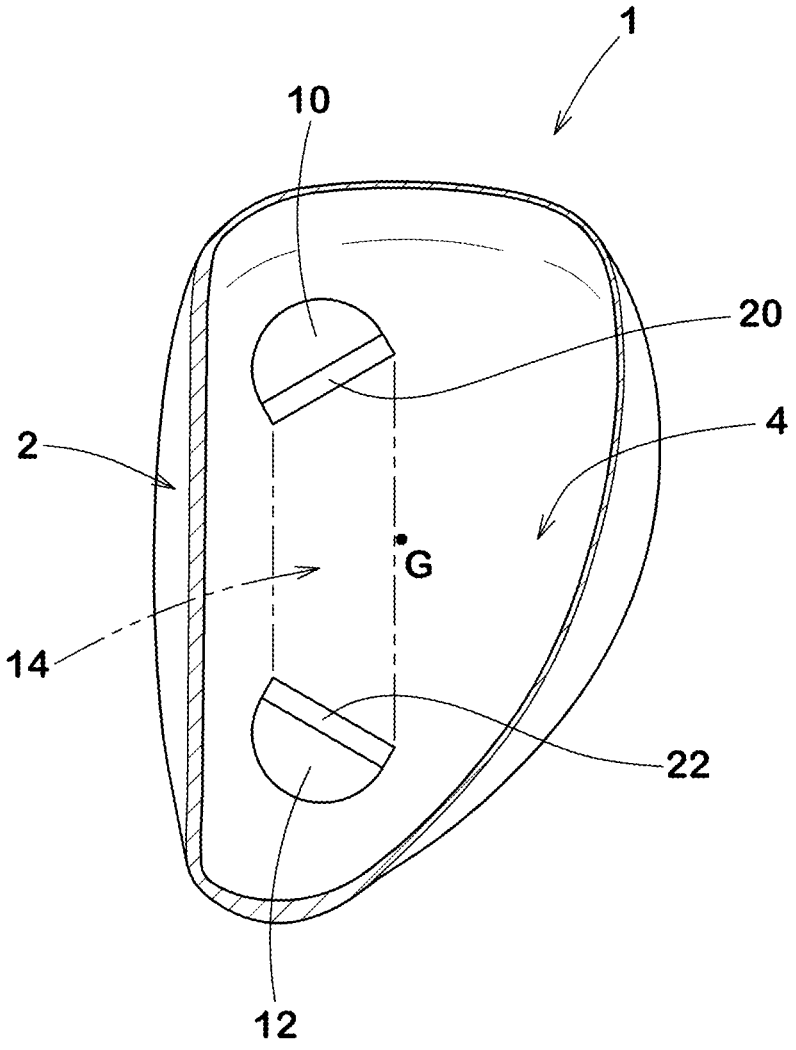
FIG. 9 is a plan view of a sole portion according to another variation.

FIG. 9 illustrates a plan view of the sole portion 4 as a variation of the toe-side through hole 20 and the heel-side through hole 22. In this embodiment, in a plan view of the head, the toe-side through hole 20 extends backwardly of the head with an inclination to the toe-side. Further, in a plan view of the head, the heel-side through hole 22 extends backwardly of the head with an inclination to the heel-side. Furthermore, the middle thin walled portion 14 is configured to have a width in the toe-heel direction increasing (e.g., gradually or continuously) backwardly of the head. In such an embodiment, a flexible deflection area of the sole portion 4 upon striking a ball is expanded backwardly of the head, helping to improve repulsion performance of the head 1 further. In this embodiment, the toe-side thick walled portion 10 and the heel-side thick walled portion 12, in a plan view of the head, each are configured to have a semicircular shape. However, those shapes are not limited to such an aspect but can be modified to various aspects.

Figure 10:
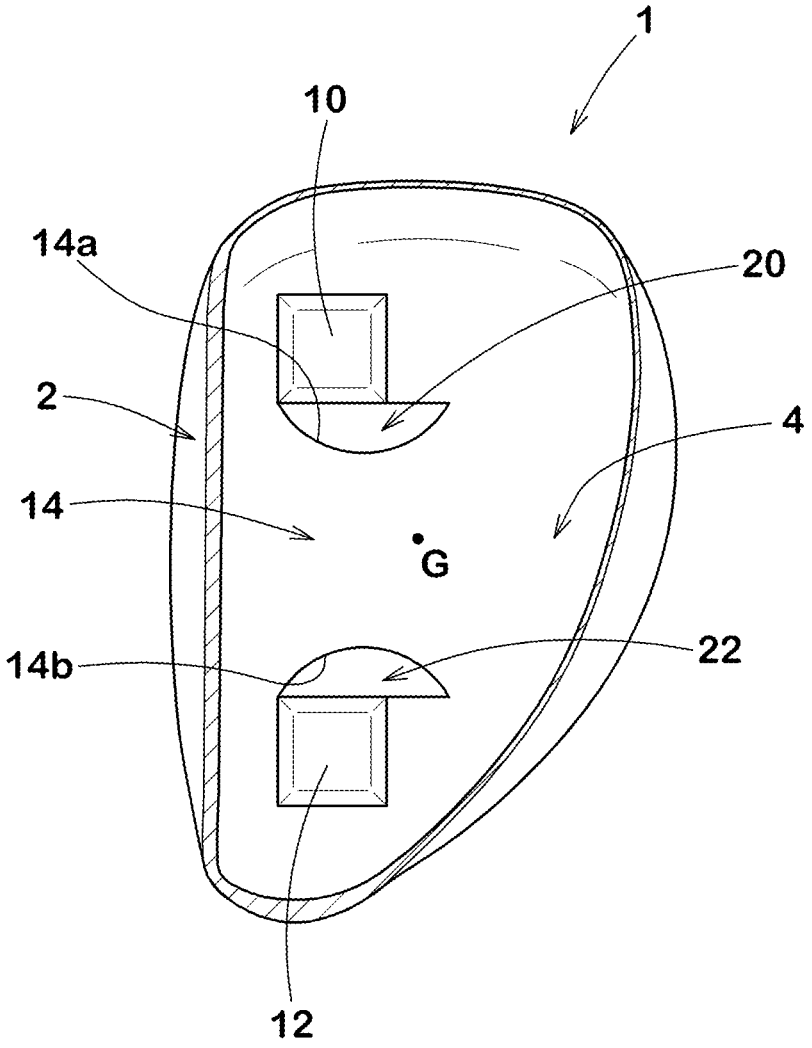
FIG. 10 is a plan view of the sole portion according to another variation.

FIG. 10 illustrates a plan view of the sole portion 4 as another variation of the toe-side through hole 20, the heel-side through hole 22 and the middle thin walled portion 14. In this embodiment, the contour shapes of the toe-side through hole 20 and the heel-side through hole 22 have been determined such that a toe-side edge 14*a* or a heel-side edge 14*b* of the middle thin walled portion 14 is recessed toward the center of the head (the club head center of gravity G side). In such an embodiment, the middle thin walled portion 14 becomes more flexible when striking a ball, helping to improve repulsion performance of the head 1 further.

Figure 11:
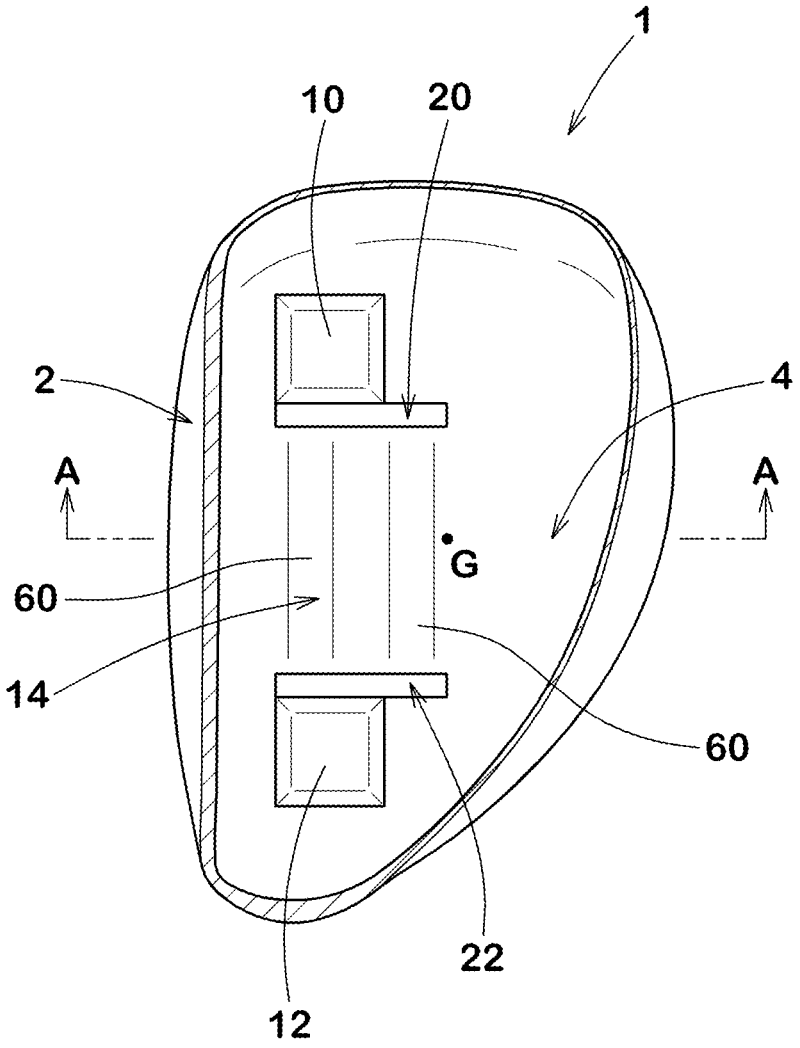
FIG. 11 is a plan view of the sole portion according to another variation.
Figure 12:
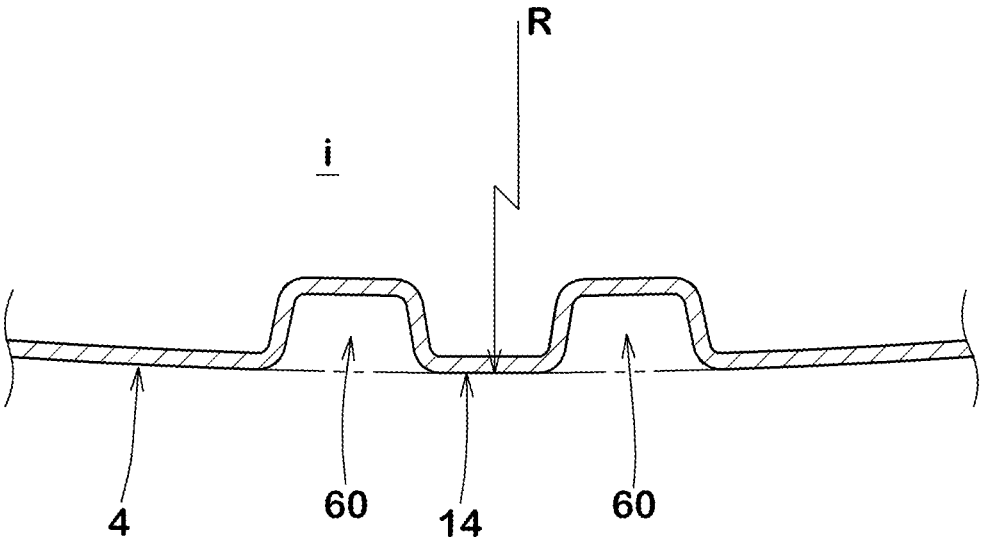
FIG. 12 is an enlarged cross-sectional view taken along lines A-A of FIG. 11.

FIG. 11 and FIG. 12 illustrates another variation of the middle thin walled portion 14. FIG. 11 is a plan view of the sole portion 4, and FIG. 12 is a partial cross-sectional view taken along lines A-A of FIG. 11. As illustrated in FIG. 11 and FIG. 12, the middle thin walled portion 14 is provided with one or more recessed grooves 60 extending in the toe-heel direction of the head 1. Such recessed grooves 60 make it easy for the middle thin walled portion 14 to deflect even in the front-back direction of the head 1 when striking a ball, improving repulsion performance of the head 1 further.

In this embodiment, a plurality of recessed grooves 60 is provided, but only a single recessed groove may be provided.

Additionally, in this embodiment, a cross-sectional shape of the recessed grooves 60 is substantially rectangular, but other shapes such as a semicircle, a sine wave, or a triangle may be employed.

In this embodiment, as illustrated in FIG. 12, the middle thin walled portion 14, as a whole, is curved to be convex toward outside the head 1. Such a middle thin walled portion 14 is easy to deflect so as to make its radius of curvature R small at the time of striking a ball, helping to improve repulsion performance of the head 1. In some other embodiments, contrary to the embodiment of FIG. 12, the middle thin walled portion 14 may be curved so as to be convex toward the hollow (i) side of the head 1.

While the particularly preferred embodiments in accordance with the disclosure have been described in detail above, the present disclosure is not limited to the above embodiments but can be modified and carried out in various aspects within the scope of the disclosure.

What is claimed is:

1. A golf club head having a hollow therein, the golf club head comprising:

a face portion; and a sole portion comprising a toe-side thick walled portion formed on a toe-side thereof, a heel-side thick walled portion formed on a heel-side thereof, and a middle thin walled portion formed between the toe-side thick walled portion and the heel-side thick walled portion, at least a part of the toe-side thick walled portion and at least a part of the heel-side thick walled portion being located on the face portion side with respect to a club head center of gravity, and the middle thin walled portion having a thickness smaller than a thickness of the toe-side thick walled portion and a thickness of the heel-side thick walled portion, wherein the sole portion is provided with a toe-side through hole piercing the sole portion between the toe-side thick walled portion and the middle thin walled portion and a heel-side through hole piercing the sole portion between the heel-side thick walled portion and the middle thin walled portion, and the toe-side thick walled portion is provided with a toe-side projected portion extending toward a heel side of the club head without contacting with an inner surface of the sole portion.

2. The golf club head according to claim 1, wherein the toe-side through hole has a length in in a front-back direction of the club head greater than a width thereof in a toe-heel direction of the club head.

3. The golf club head according to claim 1, wherein the heel-side through hole has a length in a front-back direction of the club head greater than a width thereof in a toe-heel direction of the club head.

4. The golf club head according to claim 1, wherein the thickness of the toe-side thick walled portion and the thickness of the heel-side thick walled portion are greater than 2.0 mm.

5. The golf club head according to claim 1, wherein the thickness of the middle thin walled portion is equal to or less than 2.0 mm.

6. The golf club head according to claim 1, wherein at least a part of the middle thin walled portion is provided in a region that has a 50% length of a maximum club head length in a front-back direction of the club head from a leading edge of the club head.

7. The golf club head according to claim 1, wherein in a bottom view of the club head, the toe-side projected portion extends so as to overlap with the toe-side through hole at least partially.

8. The golf club head according to claim 1, wherein the heel-side thick walled portion is provided with a heel-side projected portion extending toward a toe side of the club head without contacting with an inner surface of the sole portion.

9. The golf club head according to claim 8, wherein in a bottom view of the club head, the heel-side projected portion extends so as to overlap with the heel-side through hole at least partially.

10. The golf club head according to claim 1, wherein the middle thin walled portion is provided with one or more recessed grooves extending in a toe-heel direction of the club head.

11. The golf club head according to claim 1, wherein the golf club head has a loft angle of 13 to 35 degrees, and a sweet spot height equal to or less than 25 mm.

12. The golf club head according to claim 1, wherein in a plan view of the club head, a width of the middle thin walled portion in a toe-heel direction of the club head increases backwardly of the club head.

13. The golf club head according to claim 12, wherein the width of the middle thin walled portion increases continuously backwardly of the club head.

14. The golf club head according to claim 12, wherein in a plan view of the club head, the toe-side through hole extends backwardly of the club head with an inclination to the toe-side.

15. The golf club head according to claim 12, wherein in a plan view of the club head, the heel-side through hole extends backwardly of the club head with an inclination to the heel-side.

16. The golf club head according to claim 1, wherein in a plan view of the club head, the toe-side through hole has a contour shape such that a toe-side edge of the middle thin walled portion is recessed toward the club head center of gravity side.

17. The golf club head according to claim 1, wherein in a plan view of the club head, the heel-side through hole has a contour shape such that a heel-side edge of the middle thin walled portion is recessed toward the club head center of gravity side.

18. A golf club head having a hollow therein, the golf club head comprising:

a face portion; and a sole portion comprising a toe-side thick walled portion formed on a toe-side thereof, a heel-side thick walled portion formed on a heel-side thereof, and a middle thin walled portion formed between the toe-side thick walled portion and the heel-side thick walled portion, at least a part of the toe-side thick walled portion and at least a part of the heel-side thick walled portion being located on the face portion side with respect to a club head center of gravity, and the middle thin walled portion having a thickness smaller than a thickness of the toe-side thick walled portion and a thickness of the heel-side thick walled portion, wherein the sole portion is provided with a toe-side through hole piercing the sole portion between the toe-side thick walled portion and the middle thin walled portion and a heel-side through hole piercing the sole portion between the heel-side thick walled portion and the middle thin walled portion, and the heel-side thick walled portion is provided with a heel-side projected portion extending toward a toe side of the club head without contacting with an inner surface of the sole portion.

* * * * *